US006301450B1

(12) United States Patent
Kojima et al.

(10) Patent No.: US 6,301,450 B1
(45) Date of Patent: Oct. 9, 2001

(54) ELECTROPHOTOGRAPHY APPARATUS

(75) Inventors: Takeo Kojima; Yoshihiro Watanabe; Fumihiro Itoh; Masahiro Wanou; Yoshio Yamaguchi, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/662,906

(22) Filed: Sep. 15, 2000

(30) Foreign Application Priority Data

Nov. 5, 1999 (JP) ..... 11-314563

(51) Int. Cl.[7] ..... G03G 15/00
(52) U.S. Cl. ..... 399/24; 399/25; 399/26
(58) Field of Search ..... 399/9, 18, 24, 399/25, 26, 27, 29, 30, 31, 32, 111; 347/19

(56) References Cited

U.S. PATENT DOCUMENTS 5,923,917 * 7/1999 Sakurai et al. ..... 399/27
6,014,533 * 1/2000 Kawana ..... 399/25 X
6,097,908 * 8/2000 Uchiyama et al. ..... 399/111

FOREIGN PATENT DOCUMENTS 08-69214 3/1996 (JP) .
09-197941 7/1997 (JP) .
10-52964 2/1998 (JP) .
10-240091 9/1998 (JP) .
10-254305 9/1998 (JP) .

* cited by examiner

*Primary Examiner*—Sophia S. Chen
*Assistant Examiner*—Hoan Tran
(74) *Attorney, Agent, or Firm*—Armstrong, Westerman, Hattori, McLeland & Naughton, LLP

(57) ABSTRACT

To provide an electrophotography apparatus with which the service life management of a printing unit can be carried out properly, a non-volatile memory for storing a count value for managing the service life of the printing unit is installed in both a main unit and the printing unit of the electrophotography apparatus. Then, the count value is written to the memory on the printing unit (PU) side (PU memory) when print processing is not in progress, and no power is supplied to the PU memory during print processing, so the correct count value is always stored in the PU memory. Therefore, the service life of the printing unit can be correctly evaluated.

14 Claims, 13 Drawing Sheets

ELECTROPHOTOGRAPHY APPARATUS

BACKGROUND OF THE INVENTION

1. Field of the Invention

The present invention relates to an electrophotography apparatus used as a printer, and more particularly relates to a method for managing the service life of a printing unit replaceably built into an electrophotography apparatus.

2. Description of the Related Art

An electrophotography apparatus is a printing apparatus that performs printing by exposing a photoconductor drum to an image of the printing object, developing the image by toner adhesion, and then transferring and fixing the visibilized image to paper. In the case of color printing, the above steps are carried out for toner of four colors, namely, Y (yellow), M (magenta), C (cyan), and K (black).

The above-mentioned exposure and developing steps are executed by a printing unit replaceably built into the electrophotography apparatus. This printing unit has a photoconductor drum and so forth, and is therefore a consumable part. Accordingly, its service life should be monitored, and when the printing unit reaches the end of this service life, it must be replaced.

In the past, the service life of a printing unit has been managed using service life information such as the number of printed sheets and the operating time, which is stored in a non-volatile memory (such as an EEPROM) of the electrophotography apparatus main unit. Once the number of printed sheets reaches the specified number, or when the operating time reaches the specified time, a replacement indicator is displayed on the control panel of the electrophotography apparatus main unit, recommending to the user that the printing unit be replaced.

However, the following problem is encountered in the conventional management of printing unit service life. When the printing unit is replaced with a used unit that has not reached the end of its service life, rather than a new printing unit, service life management cannot be performed correctly because service life information such as the number of sheets printed and the operating time during the period of usage are unknown.

This problem occurs because the service life information for the printing unit is stored in the electrophotography apparatus main unit. Specifically, if the printing unit itself contained the service life information about the printing unit, then the electrophotography apparatus main unit could perform service life management on the basis of this service life information.

In view of this, a method for managing the service life has been proposed in which a non-volatile memory is installed in the printing unit, the number of printed sheets and other such information is stored therein, and this information is read by the electrophotography apparatus main unit. This allows service life management to be carried out properly even when the printing unit is replaced with a partially used unit.

Unfortunately, the function of a printing unit dictates that high voltage ranging from a few hundred to a few thousand volts be applied during operation. Consequently, there is a problem in that the signal line connecting the non-volatile memory of the printing unit to the electrophotography apparatus main unit may be affected by noise generated by the high-voltage circuit, causing the non-volatile memory to malfunction. For example, the number of printed sheets may be counted erroneously and the wrong number stored in the non-volatile memory.

When a printing unit is replaced, initial operation such as adjusting the printing density is usually carried out so that the printing will correspond to the characteristics of the replacement printing unit. To perform this initial operation, the electrophotography apparatus main unit must be notified that the printing unit has been replaced. This notification is performed by the user, who operates the control panel.

It is entirely possible, however, that the user will forget to perform this operation. If this happens, the printing density will not be adjusted even though the printing unit has been replaced, so there is the danger that the printing will not be sharp and of the appropriate printing density.

SUMMARY OF THE INVENTION

In view of this, it is an object of the present invention to provide an electrophotography apparatus with which the service life management of a printing unit can be carried out properly.

It is another object of the present invention to provide an electrophotography apparatus which can be automatically notified that the printing unit has been replaced, without any user operation.

In order to achieve the stated object, the present invention is constituted by an electrophotography apparatus in which a printing unit is replaceably built into a main unit, wherein this electrophotography apparatus comprises a first non-volatile memory mounted in the main unit, a second non-volatile memory mounted in the printing unit, and a controller for writing a count value, which is updated every specific unit of printing time or every specific number of printed sheets, as a first count value to the first non-volatile memory after every update during print processing, writing the first count value as a second count value to the second non-volatile memory upon completion of the print processing, and evaluating the service life of the printing unit on the basis of the first count value or the second count value.

Writing to the second non-volatile memory upon completion of print processing, rather than during print processing when high-voltage power is being supplied to the printing unit, allows the correct count value to be stored in the second non-volatile memory.

It is preferable if the controller does not supply power to the second non-volatile memory during print processing, but does supply power to the second non-volatile memory at least during writing to the second non-volatile memory upon completion of the print processing. This prevents malfunction of the second non-volatile memory.

Also, the controller determines whether the printing unit has been replaced on the basis of a comparison of the first count value and the second count value after the occurrence of an incident in which there is the possibility that the printing unit has been exchanged.

Automatically determining whether the printing unit has been replaced allows the processing required when the printing unit has been replaced to be executed automatically, without any input by the user through the control panel to the effect that replacement is complete.

DESCRIPTION OF THE PREFERRED EMBODIMENTS

Embodiments of the present invention will now be described, but the technological scope of the present invention is not limited to these embodiments.

Figure 1:
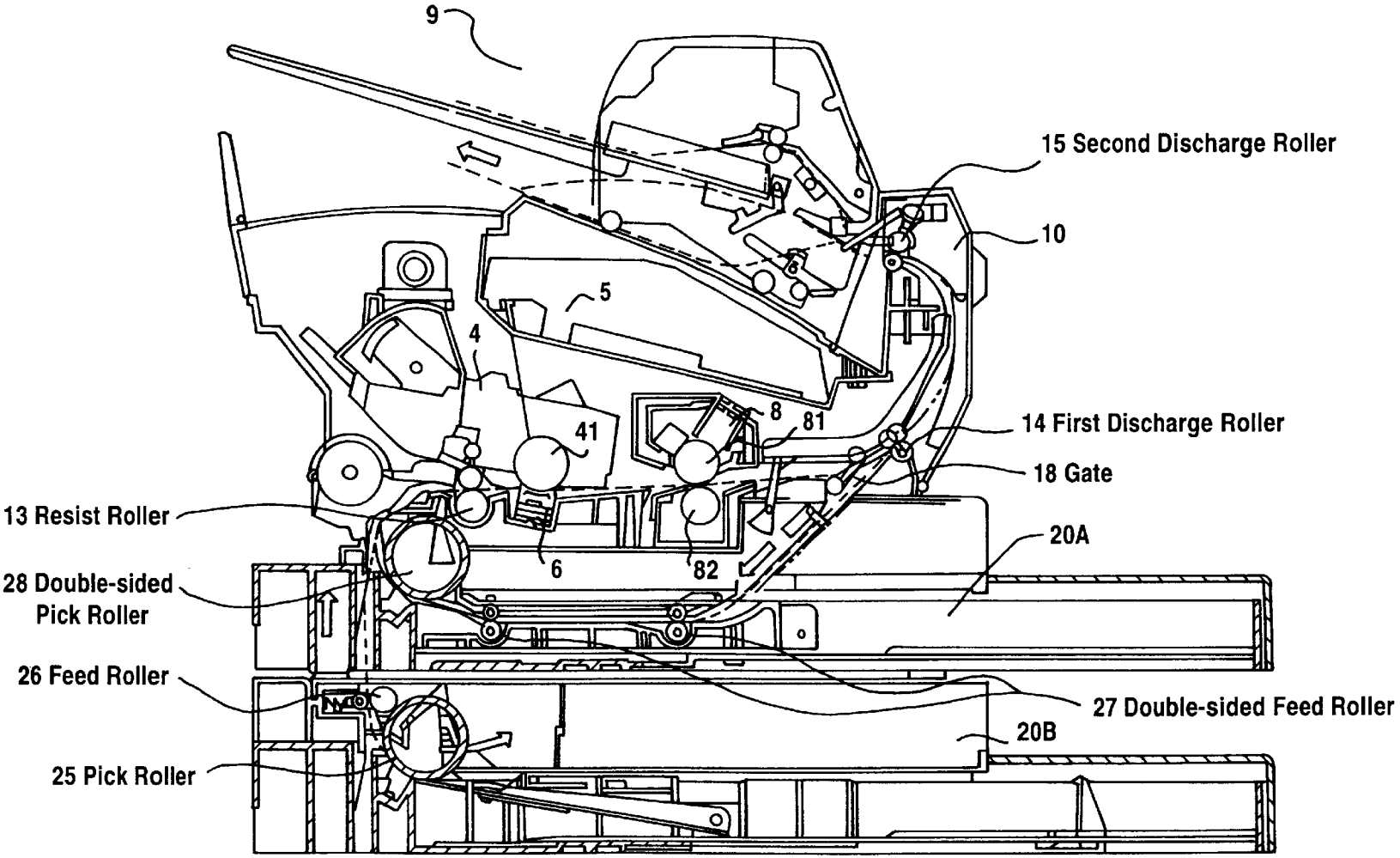
FIG. 1 is a diagram illustrating an internal structure example of the electrophotography apparatus in an embodiment of the present invention.

FIG. 1 is a diagram illustrating an internal structure example of the electrophotography apparatus in an embodiment of the present invention. An electrophotography apparatus 10 has a printing unit 4, an optical unit 5, a transfer unit 6, a fixing unit 8, and a stacker 9. The printing unit 4 is provided with a photoconductor drum 41, a developing apparatus, a cleaner, and a charger (not shown), which are required for forming the visible image that is transferred onto the paper.

To form the image that is transferred onto paper, first, the photoconductor drum 41 is uniformly charged by the charger, and the photoconductor drum 41 is exposed by the optical unit 5 on the basis of printing data from a host processor, forming a latent image. This latent image is developed by the developing apparatus, and a visible image is formed by toner on the photoconductor drum 41. This visible image is-transferred onto paper by the transfer unit 6, which faces the photoconductor drum 41 with the paper conveyance path therebetween. The fixing unit 8 holds the paper between a heating roller 81 and a pressing roller 82, the toner is softened by the heat and pressure, and the toner is fixed to the paper.

A paper supply unit 20B and a double-sided printing unit 20A, which are optional equipment, are provided at the lower part of the electrophotography apparatus 10. In printing on paper with the electrophotography apparatus 10, the paper stacked in the paper supply unit 20B is fed out one sheet at a time by a pick roller 25. This paper is conveyed upward by a feed roller 26. The paper is further conveyed by a resist roller 13, and the toner image formed by the printing unit 4 is transferred. The paper with its transferred toner image is conveyed to the fixing unit 8, where it is fixed. After this fixing, the paper is conveyed by first and second discharge rollers 14 and 15, and is discharged into the stacker 9.

In the conveyance of the paper from the paper supply unit 20B to the electrophotography apparatus 10, a motor inside the paper supply unit 20B is driven and the pick roller 25 and feed roller 26 are rotated. This rotation of the pick roller 25 feeds out the paper stacked in the paper supply unit 20B one sheet at a time and conveys it upward. The rotation of the feed roller 26 conveys the paper to the electrophotography apparatus 10, where it is printed.

When double-sided printing is performed, the paper surface undergoes the same printing process as with the above-mentioned single-sided printing, and the paper is conveyed by the first and second discharge rollers 14 and 15 until the rear end of the paper passes through a gate 18. This gate 18 is biased so that it usually blocks the conveyance path from the fixing unit 8 to the stacker 9.

This gate 18 is rotated so as to open the conveyance path from the fixing unit 8 to the stacker 9, and the paper passes through the gate 18. Once the rear end of the paper has passed through the gate 18, the gate 18 rotates back in the direction in which it blocks the conveyance path from the fixing unit 8 to the stacker 9. At the point when the rear end of the paper has passed through the gate 18, the first and second discharge rollers 14 and 15 are reversed so as to convey the paper in the opposite direction. The paper goes through the gate 18 and is conveyed to the double-sided printing unit 20A. The paper is conveyed by a double-sided feed roller 27 and a double-sided pick roller 28 to the resist roller 13.

The paper is then conveyed back by the resist roller 13, and the back of the paper is printed by the same print processing as in the single-sided printing discussed above. Once the printing on the back is complete, the paper is fixed on its back by the fixing unit 8, and is discharged to the stacker 9 by the first and second discharge rollers 14 and 15. The paper supply unit 20B and the double-sided printing unit 20A are optional equipment, and the user of the electrophotography apparatus 10 can add on equipment as needed.

Figure 2:
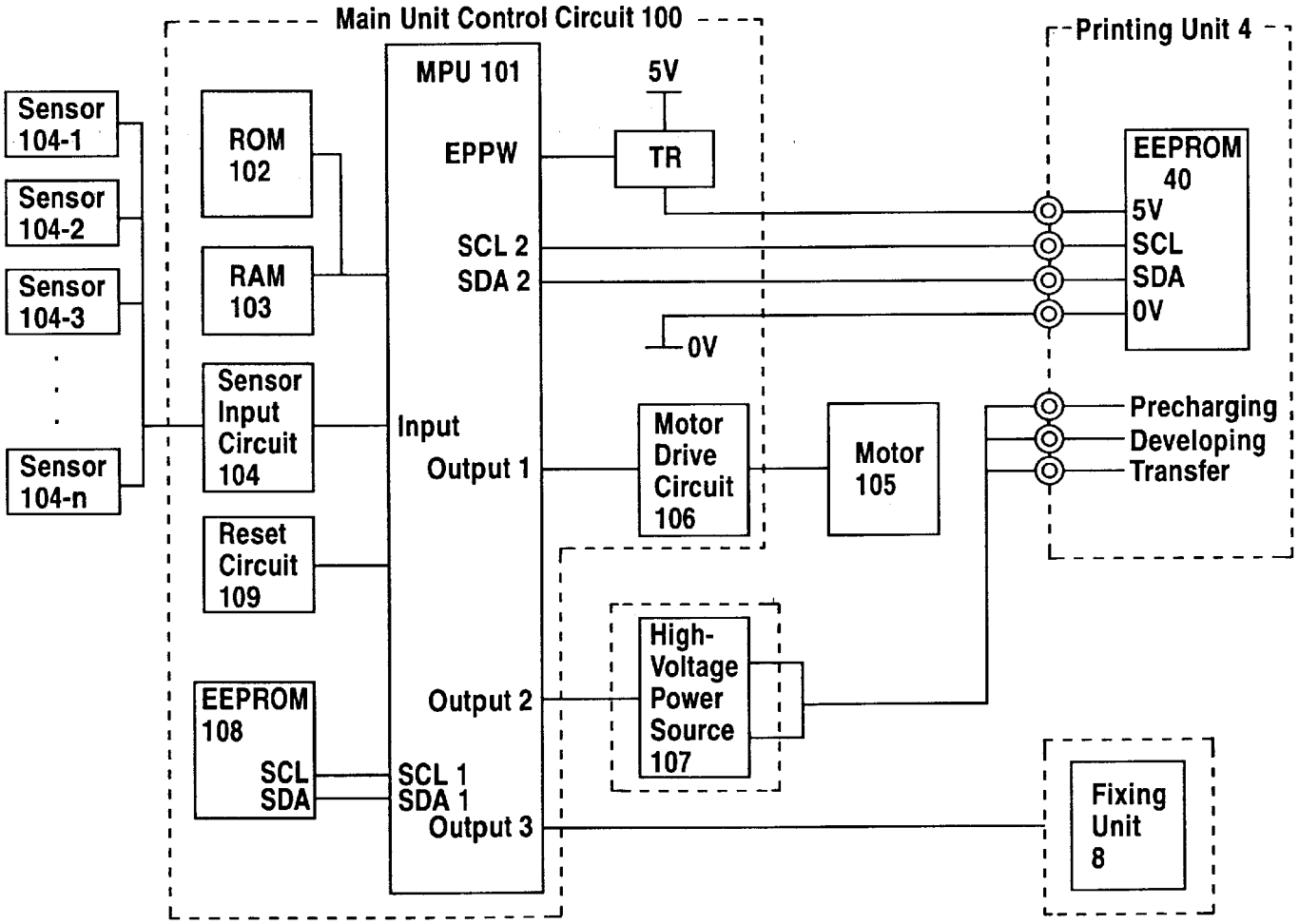
FIG. 2 is a control block diagram of the electrophotography apparatus in an embodiment of the present invention.

FIG. 2 is a control block diagram of the electrophotography apparatus in an embodiment of the present invention. In FIG. 2, an MPU 101 of a main unit control circuit 100 of the electrophotography apparatus 10 controls the various components according to a program stored in a ROM 102. A RAM 103 stores the data required in the execution of this program. A plurality of sensors 104-1, 104-2, 104-3, . . . , 104-n connected to a sensor input circuit 104 are elements that detect, for example, whether there is paper, whether the paper has passed over the paper conveyance path, whether the cover is open or closed, and whether a printing unit has been installed. A motor 105 is connected to the MPU 101 via a motor drive circuit 106. The paper is conveyed, for example, by the drive of the motor 105 according to the MPU 101. A high-voltage power source 107 controlled by the MPU 101 generates a high voltage for such operations as precharging, developing, and transfer in the printing unit 4.

The MPU 101 drives the printing unit 4. The double circles in the figure are connections between the electrophotography apparatus main unit and the printing unit 4. When the printing unit 4 is replaced, it is separated from the main unit control circuit 100 at the locations indicated by double circles.

In an embodiment of the present invention, a non-volatile memory is built into both the main unit control circuit 100 and the printing unit 4. Specifically, the main unit control circuit 100 is equipped with a non-volatile memory (such as an EEPROM) 108 connected to the MPU 101, and the printing unit 4 is also equipped with a non-volatile memory (such as an EEPROM) 40. Terminals SCL and SDA in the MPU 101 and the EEPROMS 108 and 40 are clock terminals and data terminals, respectively, for the serial transfer of data between the MPU 101 and the EEPROMs 108 and 40. The EEPROM 40 of the printing unit 4 is supplied with 5 volts of power via a transistor TR (a switching element). To prevent malfunction of and damage to the EEPROM 40, the MPU 101 controls the switching of the transistor TR so that power is not supplied to the EEPROM 40 during the print processing of the printing unit 4, and power is only supplied to the EEPROM 40 in the writing and reading of data.

When the power is turned on to the electrophotography apparatus 10, a reset circuit 109 resets the MPU 101. The MPU 101 then begins executing the program stored in the ROM 102. The MPU 101 first tests the ROM 102 and RAM 103. The MPU 101 checks the ROM 102 by checksum (processing in which the contents of the ROM are all treated as numerical values, the sum thereof is calculated, and whether or not this sum is a specified value is confirmed) or the like, and the ROM 102 is checked to see if its contents have been destroyed. The MPU 101 also writes and reads a specific value for the entire region of the RAM 103, and checks whether the written value is the same as the read value. If any abnormality should be detected in the check of the ROM 102 or the RAM 103, the MPU 101 outputs an alarm and halts operation.

Next, the EEPROM 108 of the main unit control circuit 100 is checked. The EEPROM 108 is checked, for example, by parity check for every byte. Since all of the data in the EEPROM is multiplexed and written in a plurality of regions of two or more bytes, the EEPROM 108 is checked by mutual comparison of the values of this data. The check of the EEPROM 108 should turn up any abnormality, the erroneous data is corrected on the basis of the data believed to be correct out of the multiplexed data. If correction is impossible, then either the data in the EEPROM is initialized to the default values and the operation of the MPU 101 is continued, or an alarm is outputted and the operation of the MPU 101 is halted. Whether to continue or halt the operation of the MPU 101 is determined depending on the importance of the uncorrectable data.

The same checks as above are also performed for the EEPROM 40 of the printing unit 4.

After the power has been turned on and the initialization operation discussed above has been completed, the electrophotography apparatus executes print processing on the basis of a print command from a host device. In an embodiment of the present invention, information about service life such as the number of printed sheets and the operating time of the printing unit 4 is written to both the EEPROM 108 of the main unit control circuit 100 and the EEPROM 40 of the printing unit 4. An embodiment of the present invention will now be described in further detail using the number of printed sheets as an example.

Figure 3:
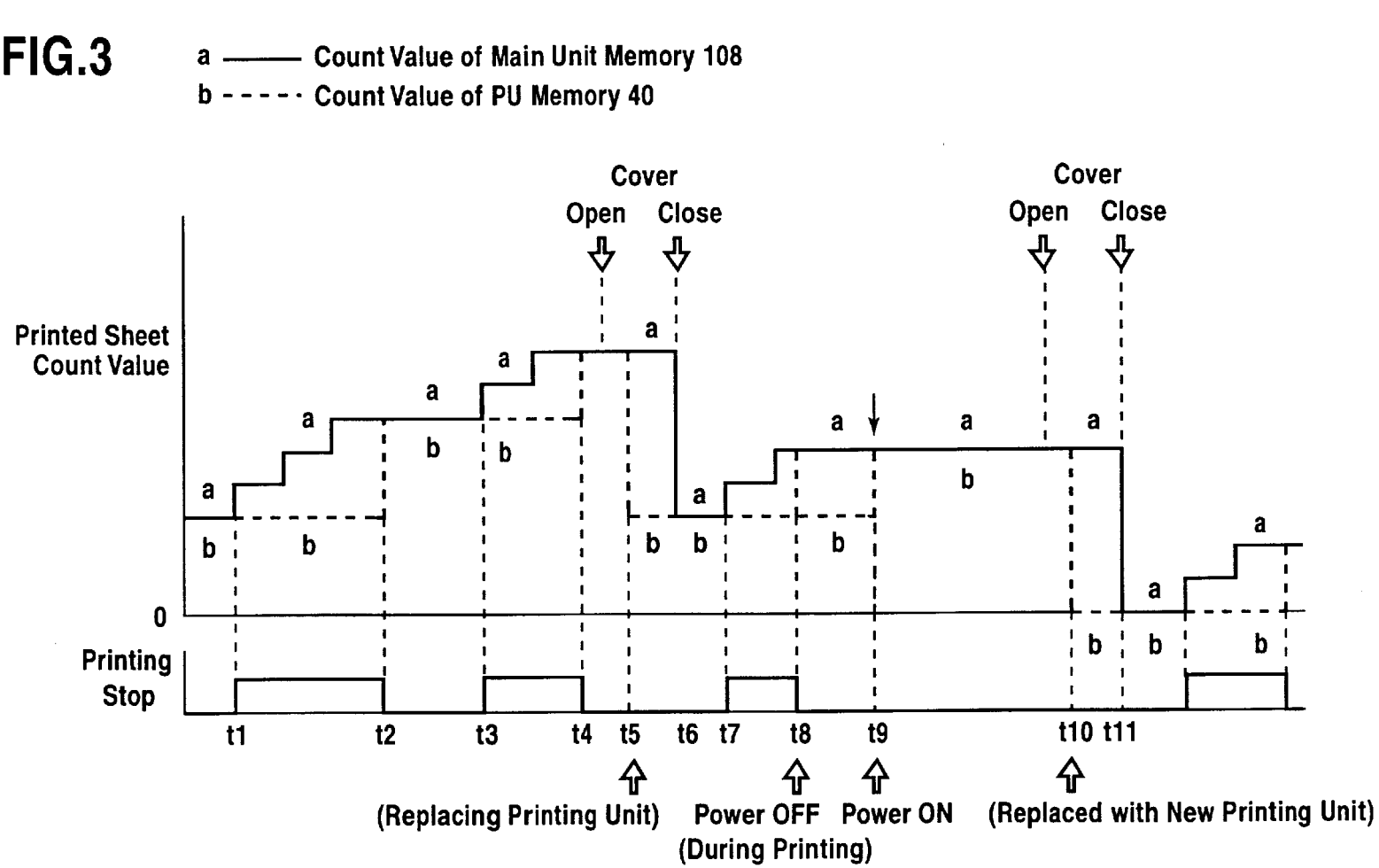
FIG. 3 is a diagram illustrating the relation between the printed sheet count value of a main unit memory 108 and the printed sheet count value of a PU memory 40 in a first embodiment of the present invention.

FIG. 3 is a diagram illustrating the relation between the printed sheet count value of a main unit memory 108 and the printed sheet count value of a PU memory 40 in a first embodiment of the present invention. In FIG. 3, the solid lines a indicate the printed sheet count values of the EEPROM 108 of the main unit control circuit 100 (hereinafter referred to as main unit memory), and the dotted lines b indicate the count values of the EEPROM 40 of the printing unit 4 (hereinafter referred to as the PU memory). Where the solid lines a overlap the dotted lines b in FIG. 3, this is indicated by just one type of line for the purposes of the figure. The count value of the EEPROM 108 prior to the start of printing is equal to the count value of the PU memory 40.

Printing is performed during the period from time t1 to t2. During this time, the count value a of the main unit memory 108 is updated every time a sheet is printed. Meanwhile, the count value b of the PU memory 40 is not updated during printing. At time t2 when the printing is complete, the count value b of the PU memory 40 is updated to the count value a of the main unit memory 108.

There is no danger of the PU memory 40 malfunctioning since the MPU 101 controls the system so that no power is supplied to the PU memory 40 during print processing. Upon completion of the print processing of the printing unit 4, power is supplied to the PU memory 40 and the count value a of the main unit memory 108 is written, so the correct count value can be stored on the PU memory 40 side as well.

In print processing during the period from time t3 to t4, just as above, the count value of the main unit memory 108 is updated every time a sheet is printed, and upon completion of the printing the count value a of the main unit memory 108 is written to the PU memory 40.

After this, the cover is opened in order to replace the printing unit, and the printing unit is replaced at time t5 with another printing unit that is partially used. When the cover is closed at time t6, the count value a of the main unit memory 108 and the count value b of the PU memory 40 are compared.

If the two count values do not match, and if the difference thereof is over the specified number of sheets, it is determined that the printing unit has been replaced, and the count value b of the PU memory 40 is written to the main unit memory 108. Conversely, if this difference is within the specified number of sheets, as will be discussed below, it is determined that the printing unit has not been replaced, and the count value of the main unit memory 108 is written to the PU memory 40. The specified number of sheets is, for example, the maximum number of continuously printed sheets possible with the electrophotography apparatus, or a number of sheets less than this.

At time t6, since the printing unit has been replaced, it is very likely that the count value of the PU memory 40 of the other replacement printing unit will be very different from the count value of the main unit memory 108. Specifically, the difference between the count value of the PU memory 40 and the count value of the main unit memory 108 will be over the above-mentioned specified number of sheets, so in this case, the count value b of the PU memory 40 is written to the main unit memory 108.

When the count values of the two memories are thus compared when the cover is opened, and the difference between them is over the specified number of sheets, it is determined that the printing unit has been replaced. The count value of the main unit memory 108 is updated to the count value of the PU memory 40.

Print processing commences at time t7. Just as described above, the count value of the main unit memory 108 is updated every time a sheet is printed. Then, the power is forcibly turned off at time t8 prior to the completion of the print processing. When this happens, since the comparison and updating of the count values at the end of the print processing have not been performed, the count values of the two memories remain unmatched.

When the power is turned back on at time t9, the comparison and updating of the count values are performed. In this case, the difference between the two count values is within the above-mentioned specified number of sheets. This is because the printing unit has not been replaced, so the maximum difference between the two count values falls within the number of continuously printed sheets. Therefore, at time t9, the count value a of the main unit memory 108 is written to the PU memory 40. Specifically, the count value b of the PU memory 40 is updated to the count value a of the main unit memory 108.

After this, the cover is opened in order to replace the printing unit, and the printing unit is replaced at time t10 with a new replacement printing unit. When the cover is closed at time t11, the count value a of the main unit memory 108 is compared to the count value b of the PU memory 40. Since a new printing unit has been installed, the count value of the PU memory 40 is zero. Therefore, the difference between the count value b of the PU memory 40 and the count value a of the main unit memory 108 is over the above-mentioned specified number of sheets, so in this case the count value a of the main unit memory 108 is updated to the count value b of the PU memory 40.

Thus, in this embodiment of the present invention, the count value of the main unit memory 108 is compared to the count value of the PU memory 40 when the power is on and the cover open. If the difference between these values is within the specified number of sheets, it is determined that the printing unit has not been replaced, and the count value of the PU memory 40 is updated to the count value of the main unit memory 108. On the other hand, if this difference is over the specified number of sheets, it is determined that the printing unit has been replaced, and the count value of the main unit memory 108 is updated to the count value of the PU memory 40. Specifically, whether the printing unit has been replaced can be automatically determined on the basis of the difference between the count value of the main unit memory 108 and the count value of the PU memory 40.

Furthermore, because the count value is written to the PU memory 40 at a time other than during print processing, and power is not supplied to the PU memory 40 during print processing in order to prevent malfunctioning, the correct count value is always stored in the PU memory 40. Once the count value of the PU memory 40 or the count value of the main unit memory 108 (the two are equal under normal circumstances) reaches a set value, the MPU 101 determines that the printing unit 4 has reached the end of its service life. An indicator recommending the replacement of the printing unit is displayed on the control panel.

Whether the printing unit 4 has been replaced may also be determined with the following criteria.

(1) Value of main unit memory 108< value of PU memory 40: Has been replaced (2) Value of main unit memory 108≧ value of PU memory 40: Has been replaced (3) Other: Has not been replaced The count value of the main unit memory 108 and the count value of the PU memory 40 will vary during printing, but the value of the PU memory 40 never exceeds that of the main unit memory 108. When the replacement is a used printing unit, scenario (1) occurs, so it is determined that the printing unit has been replaced.

Also, the count values of the two memories will vary by the number of continuously printed sheets during printing, but this difference never goes over the maximum possible number of continuously printed sheets $\alpha$ (such as 500 sheets). It is therefore determined that the printing unit has been replaced if the difference is greater than $\alpha$, as in scenario (2).

In scenario (3), the value of the main unit memory is greater than the value of the PU memory, and the difference thereof is not greater than $\alpha$. In this case, it cannot be determined whether the difference in the values of the two memories is the result of turning off the power during continuous printing or is the result of the printing unit having been replaced, so it is determined that the printing unit has not been replaced.

The value of $\alpha$ may also be less than the maximum possible number of continuously printed sheets. For instance, it may be the number of sheets commonly continuously printed (a few dozen sheets). Also, the number of sheets continuously printed the past N times may be stored in a separate region of the main unit memory 108, and the maximum number thereof may be set as $\alpha$.

Figure 4:
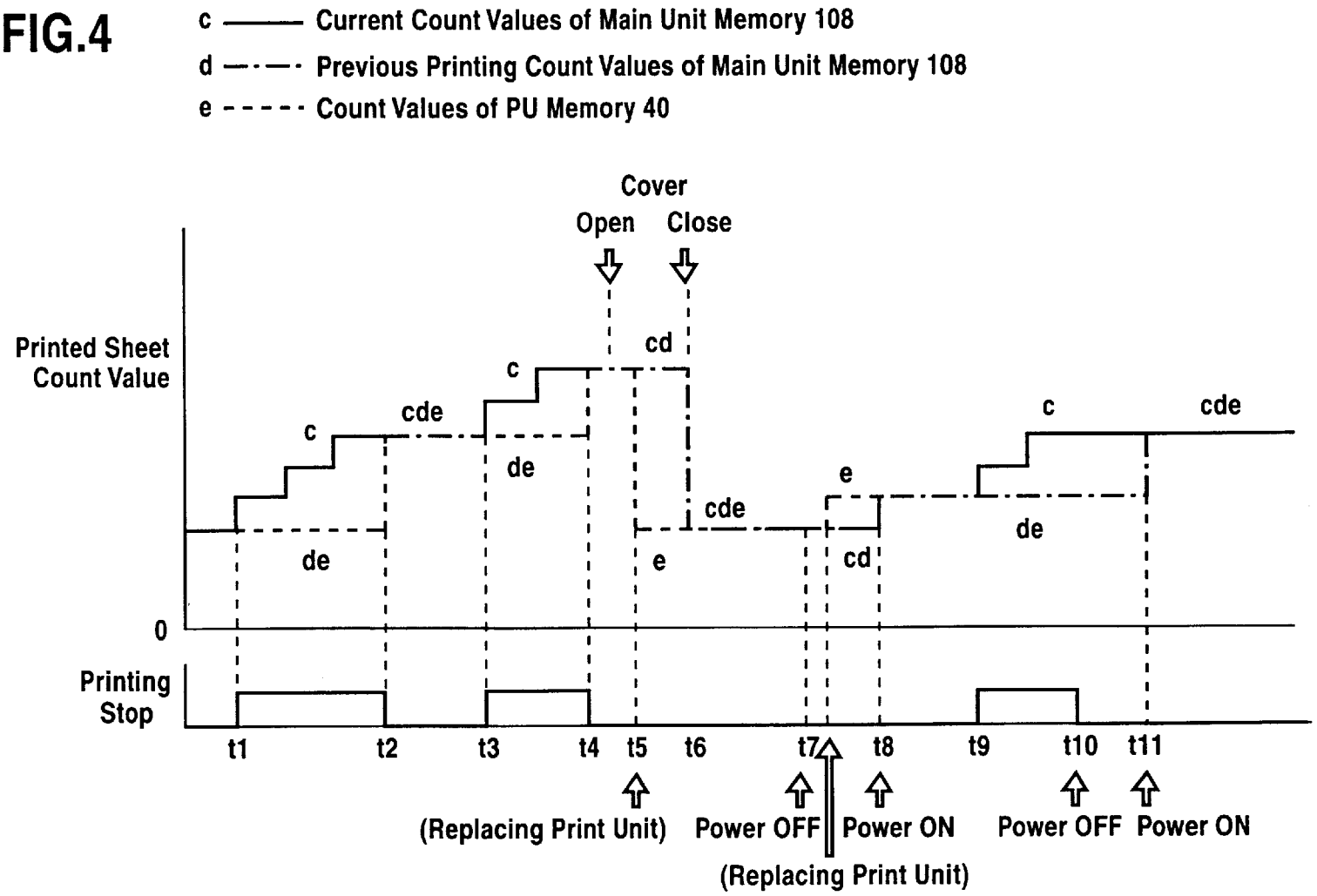
FIG. 4 is a diagram illustrating the relation between the printed sheet count value of a main unit memory 108 and the printed sheet count value of a PU memory 40 in a second embodiment of the present invention.

FIG. 4 is a diagram illustrating the relation between the printed sheet count value of a main unit memory 108 and the printed sheet count value of a PU memory 40 in a second embodiment of the present invention. In this second embodiment, the main unit memory 108 stores the count value up to the completion of the previous print processing (hereinafter referred to as the previous printing count value) in addition to the count value updated every time a sheet is printed during print processing (hereinafter referred to as the current count value). The previous printing count value of the main unit memory 108 is compared to the count value of the PU memory 40. In FIG. 4, the solid lines c indicate current count values of the main unit memory 108, the one-dot chain lines d indicate previous printing count values of the main unit memory 108, and the dotted line e indicate the count values of PU memory 40. Where the solid lines c, the one-dot chain lines d, and the dotted lines e overlap in FIG. 3, this is indicated by just one type of line for the purposes of the figure. The current count value and the previous printing count value of the main unit memory 108 prior to the start of printing are equal to the count value of the PU memory 40.

Printing is performed during the period from time t1 to t2. During this time, the current count value c of the main unit memory 108 is updated every time a sheet is printed. Meanwhile, the previous printing count value d of the main unit memory 108 and the count value e of the PU memory 40 are not updated during printing. At time t2 when the printing is complete, the previous printing count value d of the main unit memory 108 and the count value e of the PU memory 40 are updated to the current count value c of the main unit memory 108. Specifically, the current count value c of the main unit memory 108 is written to the PU memory 40 and the previous count value region of the main unit memory 108.

In print processing during the period from time t3 to t4, just as above, the count value of the main unit memory 108 is updated every time a sheet is printed, and upon completion of the printing at time t4 the previous printing count value d of the main unit memory 108 and the count value e of the PU memory 40 are updated to the current count value c of the main unit memory 108.

After this, the cover is opened in order to replace the printing unit, and the printing unit is replaced at time t5 with another printing unit that is partially used. When the cover is closed at time t6, the previous printing count value d of the main unit memory 108 and the count value e of the PU memory 40 are compared. Since the printing unit has been replaced, the count value e of the PU memory 40 of the replacement printing unit differs from the previous printing count value d of the main unit memory 108. In this case it is determined that the printing unit has been replaced. The current count value c and the previous printing count value d of the main unit memory 108 are then updated to the count value e of the PU memory 40. Specifically, the count value e of the PU memory 40 is written to the current count value c region and the previous printing count value d region of the main unit memory 108.

Thus, when the cover is closed, the previous printing count value d of the main unit memory 108 and the count value e of the PU memory 40 are compared, and it is determined that the printing unit has been replaced if the two count values are different. The current count value and the previous printing count value of the main unit memory 108 are updated to the count value of the PU memory 40. On the other hand, if the two count values match, it is determined that the printing unit has not been replaced, as discussed below.

The power is turned off at time t7, after which the printing unit is replaced. Therefore, the count value of the PU memory 40 changes at this point. The power is then turned back on at time t8. When the power is turned on, the previous printing count value d of the main unit memory 108 and the count value e of the PU memory 40 are compared. In this case, the two count values are different, so it is determined that the printing unit has been replaced, and the current count value c and the previous printing count value d of the main unit memory 108 are updated to the count value e of the PU memory 40 of the replacement printing unit 4.

Print processing commences at time t9. The current count value c of the main unit memory 108 is updated every time a sheet is printed. The previous printing count value d of the main unit memory 108 and the count value e of the PU memory 40 are not updated during printing. The power is turned off at time t10. In this case, the previous printing count value of the main unit memory 108 and the count value of the PU memory 40 are not updated upon completion of the print processing.

If the power is turned on in this state at time t11, first, the previous printing count value d of the main unit memory 108 is compared to the count value e of the PU memory 40. Since the printing unit is not replaced between time t10 and time t11, the two count values match. This matching of the two count values makes it possible to determine that the printing unit has not be replaced.

The current count value c of the main unit memory 108 is then compared to the count value e of the PU memory 40. In this case, the two count values are different, and the current count value c of the main unit memory 108 is the correct count value. Therefore, the count value e of the PU memory 40 is updated to the current count value of the main unit memory 108. The previous printing count value d of the main unit memory 108 is also updated to the current count value c of the main unit memory 108.

Thus, in this embodiment of the present invention, the count value of the main unit memory 108 and the count value of the PU memory 40 are compared when the power is on and the cover open. If the two count values are different, it is determined that the printing unit has been replaced. The count value e of the PU memory 40 is then written to the current count value c region and the previous printing count value d region of the main unit memory 108.

Meanwhile, if the two count values match, it is determined that the printing unit has not be replaced. If the current count value c of the main unit memory 108 and the count value e of the PU memory 40 are different, then the current count value c of the main unit memory 108 is written to the previous printing count value d region of the main unit memory 108 and the PU memory 40.

Therefore, again in this second embodiment, whether the printing unit has been replaced can be automatically determined on the basis of the difference between the count value of the main unit memory 108 and the count value of the PU memory 40.

Moreover, in the above-mentioned first embodiment, it was determined that the printing unit had not been replaced if the difference between the count value a of the main unit memory 108 and the count value b of the PU memory 40 of the replacement printing unit happened to be less than or equal to the specified number of sheets, but with this second embodiment, whether the printing unit has been replaced can be determined merely by whether or not there is a difference between the count values, regardless of the magnitude of this difference.

Furthermore, just as above, because the count value is written to the PU memory 40 at a time other than during print processing, and power is not supplied to the PU memory 40 during print processing in order to prevent malfunctioning, the correct count value is always stored in the PU memory 40.

Figure 5:
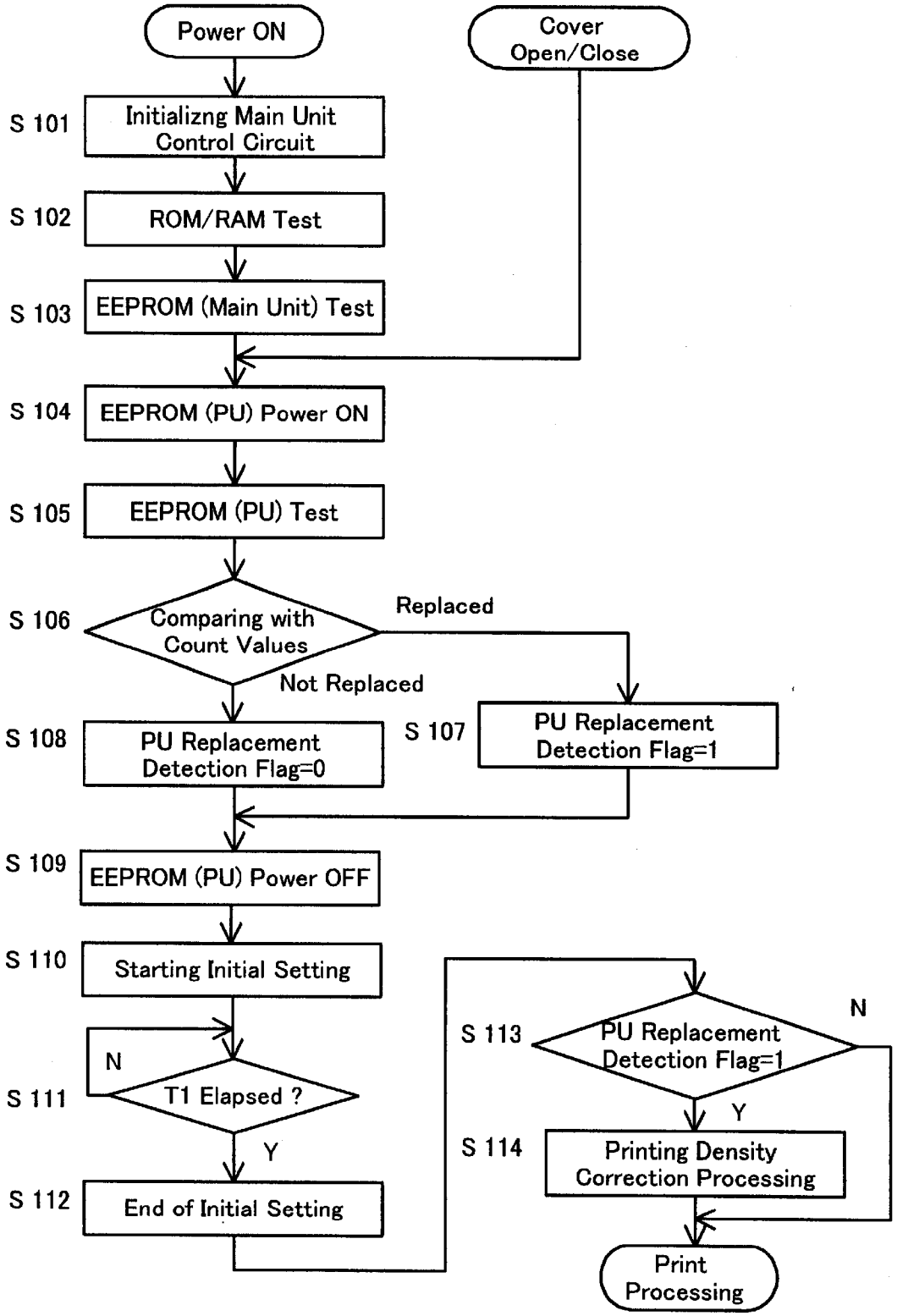
FIG. 5 is a flow chart of a first initialization of the electrophotography apparatus in an embodiment of the present invention.

FIG. 5 is a flow chart of a first initialization (power on) of the electrophotography apparatus in an embodiment of the present invention.

When the power is turned on, first, the main unit control circuit 100 is initialized (reset) in step S101. In step S102 the above-mentioned test is performed on the ROM 102 and RAM 103. Then, in step S103 the main unit memory 108 of the main unit control circuit 100 is tested. In step S104 power is supplied to the PU memory 40 of the printing unit 4. Processing after step S104 is shared with the operation when the cover is opened.

The PU memory 40 is tested in step S105. In step S106 the count values of the main unit memory 108 and the PU memory 40 are compared. More specifically, when the above-mentioned first embodiment is applied, it is determined whether or not the difference between the count value of the main unit memory 108 and the count value of the PU memory 40 exceeds the specified number of sheets. If this difference does exceed the specified number of sheets, it is determined that the printing unit 4 has been replaced, and a PU replacement detection flag is set to "1" in step S107. If the difference is less than or equal to the specified number of sheets, it is determined that the printing unit 4 has not been replaced, and the PU replacement detection flag is cleared to "0" in step S108. Alternatively, an evaluation is made from the above-mentioned criteria (1), (2), and (3), and the flag is set to "1" if it is determined that the printing unit has been replaced, but the flag is cleared to "0" if it is determined that the printing unit has not been replaced.

When the above-mentioned second embodiment is applied to step S106, it is determined whether or not the previous printing count value of the main unit memory 108 matches the count value of the PU memory 40. If they do not match, it is determined that the printing unit has been replaced, and the PU replacement detection flag is set to "1" in step S107. If they do match, it is determined that the printing unit has not been replaced, and the PU replacement detection flag is cleared to "0" in step S108.

Upon completion of the count value comparison (step S106) and the PU replacement detection flag processing (step S107), the power to the PU memory 40 is turned off in step S109. Initial setting is commenced in step S110. This initial setting involves processing such as rotating the motor 105 and supplying high-voltage power to the printing unit 4. This initial setting is completed within a time T1. Therefore, when time T1 has elapsed since the start of the initial setting (step S111), it is determined that the initial setting has been completed (step S112).

When the initial setting is complete, the value of the PU replacement detection flag ("1" or "0") is found in step S113, and if the flag is "1," it is determined that the printing unit 4 has been replaced, so printing density correction processing is performed in step S114. In this printing density correction processing, the printing density in a test printing is measured, and the amount of light generated in the optical unit 5, the exposure time, and so forth are adjusted so that this measured density will fall within a preset specific density range.

Upon completion of the printing density correction processing, or when the flag is "0," print processing is executed on the basis of a print command from a host device.

Figure 6:
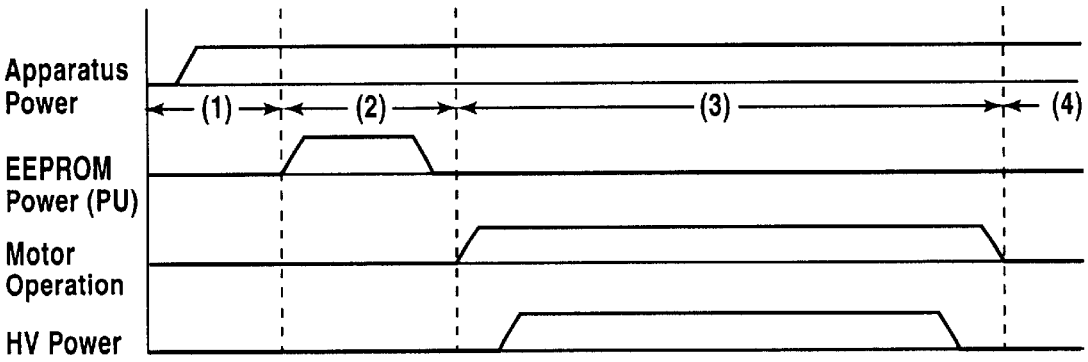
FIG. 6 is a diagram illustrating the timing of the power supply to the PU memory 40 during initialization.

FIG. 6 is a diagram illustrating the timing of the power supply to the PU memory 40 during initialization. Period ① after the power has been turned on to the apparatus is the processing period for steps S101 to S103 in the processing flow chart in FIG. 5. Period ② is the period in which power is supplied to the PU memory 40, and is the processing period for steps S104 to S109. Period ③ is the period in which the initial setting and printing density correction processing of steps S110 to S114 are performed. In this period, the motor is driven and high-voltage (HV) power is supplied to the printing unit 4, so if the power is on to the PU memory 40, there is the danger that noise will be admixed and an unexpected erroneous write will occur. Therefore, the power to the PU memory 40 is off during this period. Period ④ is a print command stand-by period, and both the motor drive and the high-voltage power supply are halted. The timing of the supply of power to the PU memory 40 during initialization in FIGS. 7 and 8 (discussed below) is the same as in FIG. 6.

Figure 7:
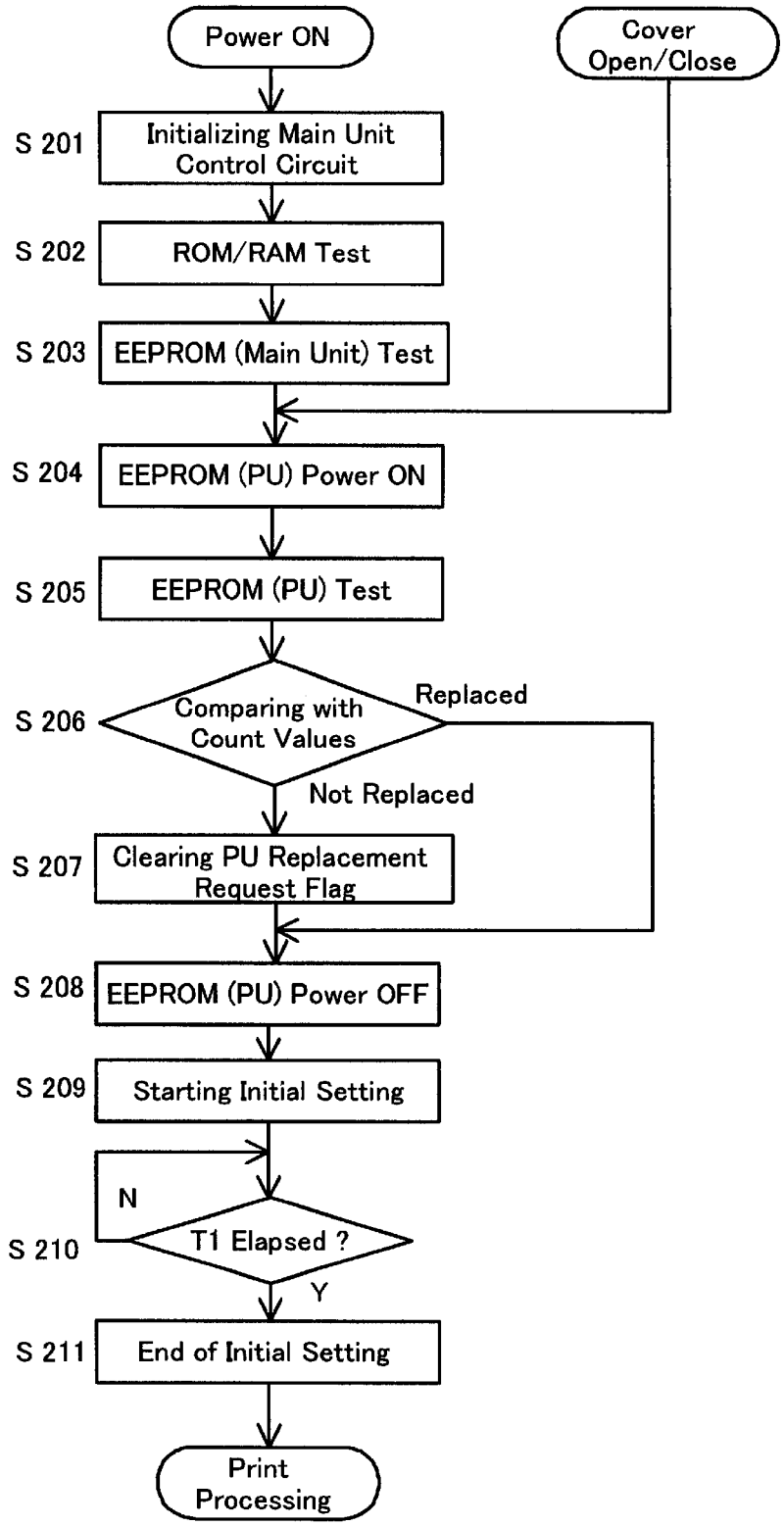
FIG. 7 is a flow chart of a second initialization of the electrophotography apparatus in an embodiment of the present invention.

FIG. 7 is a flow chart of a second initialization of the electrophotography apparatus in an embodiment of the present invention. Steps S201 to S206 in FIG. 7 are the same as steps S101 to S106 in FIG. 5, and will therefore not be described again.

If it is determined in the count value comparison of step S206 that the printing unit 4 has been replaced, then a PU replacement request flag is cleared (step S207). The PU replacement request flag is used for displaying a replacement indicator on the control panel of the electrophotography apparatus main unit when the number of sheets printed by the printing unit 4 reaches a set number. If it is determined that the printing unit 4 has been replaced, then the PU replacement request flag is cleared in order to cancel the display of the replacement indicator.

Steps S208 to S211 are the same as steps S109 to S112 in FIG. 5, and will therefore not be described again. Printing density correction processing may be performed automatically upon completion of the initial setting in step S211.

Figure 8:
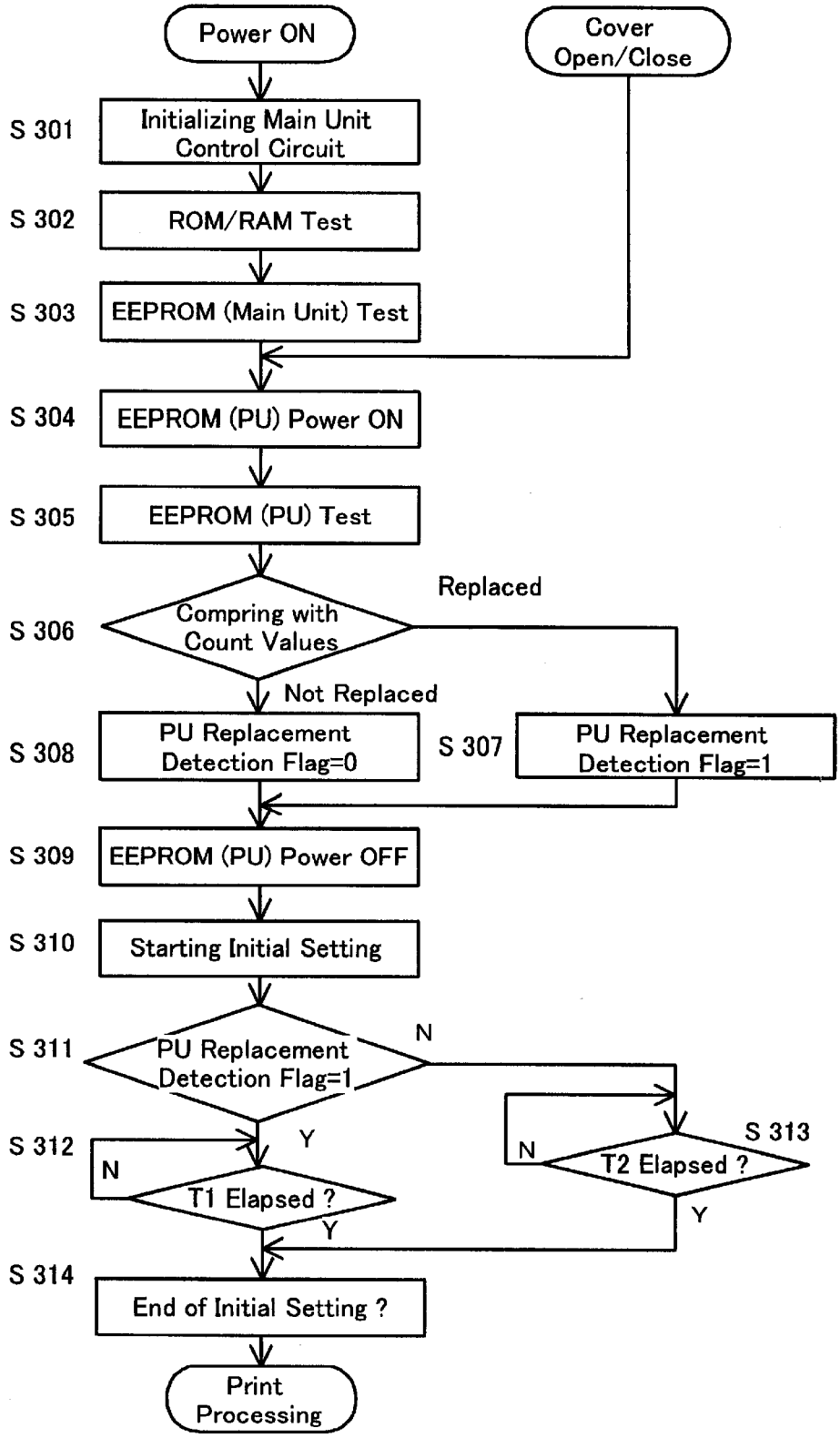
FIG. 8 is a flow chart of a third initialization of the electrophotography apparatus in an embodiment of the present invention.

FIG. 8 is a flow chart of a third initialization of the electrophotography apparatus in an embodiment of the present invention. In FIG. 8, steps S301 to S310 are the same as steps S101 to S110 in FIG. 5, and will therefore not be described again. When the initial setting is commenced in step S310, the value of the PU replacement detection flag ("1" or "0") is found in step S311, and if the flag is "0," then just as in step S111 in FIG. 5, initial setting is complete (step S314) after time T1 for ordinary initial setting has elapsed (step S312). Meanwhile, if the flag is "1," initial setting is complete (step S314) after the elapse of time T2, which is longer than time T1 (step S313).

If the flag is "1," that is, if it is determined that the printing unit 4 has been replaced, then enough time for the toner to be dropped from the toner cartridge to the printing unit must be ensured as the time for initial setting. Therefore, if the flag is "1," then time T2, which is longer than time T1, is set as the time for initial setting.

Figure 9:
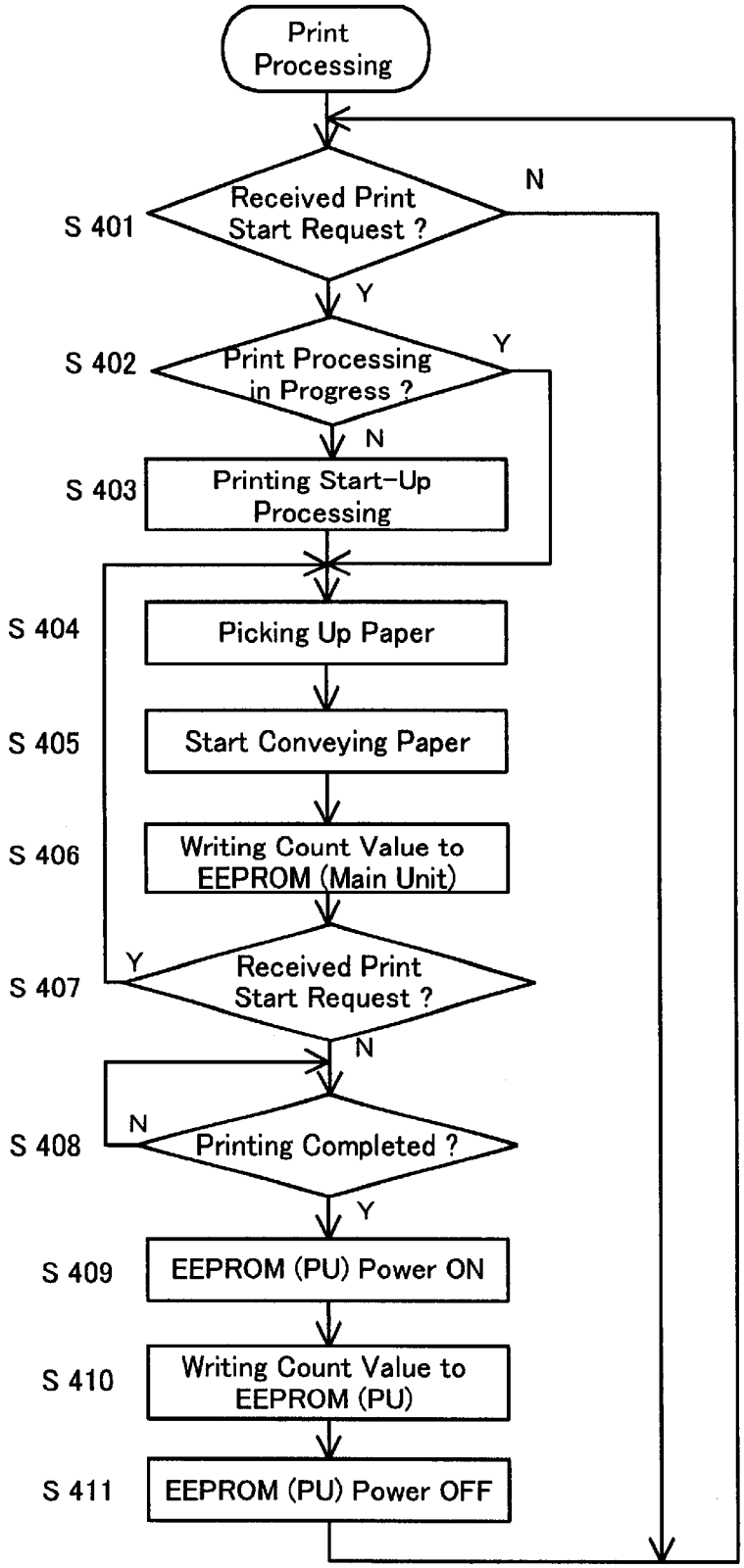
FIG. 9 is a flow chart of the print processing of the electrophotography apparatus in the first embodiment of the present invention.

FIG. 9 is a flow chart of the print processing of the electrophotography apparatus in the first embodiment of the present invention. In FIG. 9, if a print start request (print command) is received from a host device in step S401, it is determined in step S402 whether the print processing is already in progress, that is, whether continuous printing is being performed. In the printing start-up processing, for example, the printing unit 4 is driven and the fixing unit 8 heated.

In step S404 the paper is picked up from the paper supply unit. Then, in step S405 as the paper begins to be conveyed, the count value is written to the main unit memory 108 of the main unit control circuit 100 in step S406. Specifically, the count value of the main unit memory 108 is incremented by one.

In step S407, if there is another print start request, then the above steps S404 to S406 are repeated, and the count value of the main unit memory 108 is incremented by one every time a sheet of paper is conveyed.

If the printing is complete in step S408, then power is supplied to the PU memory 40 of the printing unit 4 in step S409, and the count value of the main unit memory 108 is written to the PU memory 40 in step S410. After this, the supply of power to the PU memory 40 is halted.

Figure 10:
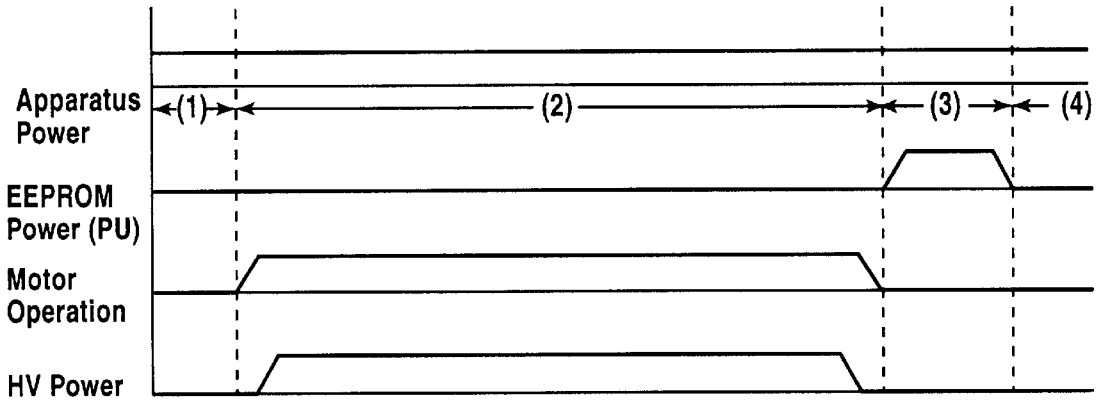
FIG. 10 is a diagram illustrating the timing of the power supply to the PU memory 40 during print processing.

FIG. 10 is a diagram illustrating the timing of the power supply to the PU memory 40 during print processing. Referring to the processing flow chart of FIG. 9, the power to the apparatus remains on. Period ① is a print stand-by period. Period ② is the period of the printing state, and corresponds to the processing period of steps S403 to S408. In this period, the motor is driven and high-voltage power is supplied to the printing unit 4. When printing is complete, the motor drive and the high-voltage power supply are halted. Period ③ is the processing period of steps S409 to S411 after completion of printing. Therefore, here again, the supply of power to the PU memory 40 is halted while the motor is being driven and the high-voltage power is being supplied, which prevents malfunction of the PU memory 40. The timing of the supply of power to the PU memory 40 during initialization in FIG. 11 is the same as in FIG. 10.

Figure 11:
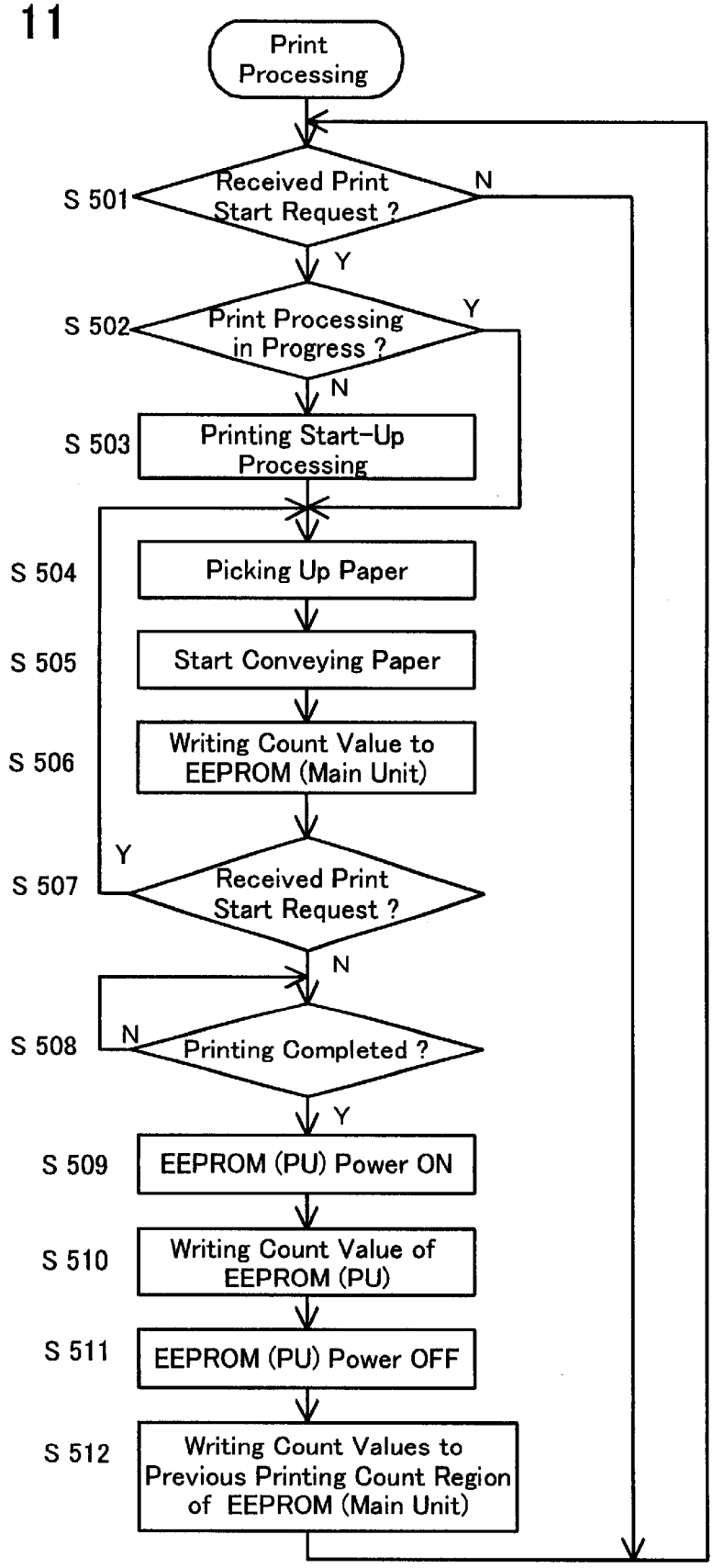
FIG. 11 is a flow chart of the print processing of the electrophotography apparatus in the second embodiment of the present invention.

FIG. 11 is a flow chart of the print processing of the electrophotography apparatus in the second embodiment of the present invention. Steps S501 to S511 in FIG. 11 are the same as steps S401 to S411 in FIG. 9, and will therefore not be described again. In step S506, however, the count value is written to the current count value region of the main unit memory 108 of the main unit control circuit 100. Specifically, the count value in the region of the current count value of the main unit memory 108 is incremented by one.

Then, in step S512 the count value is written to the previous printing count value region of the main unit memory 108 of the main unit control circuit 100. Specifically, the previous printing count value is updated to the current count value.

Figure 12:
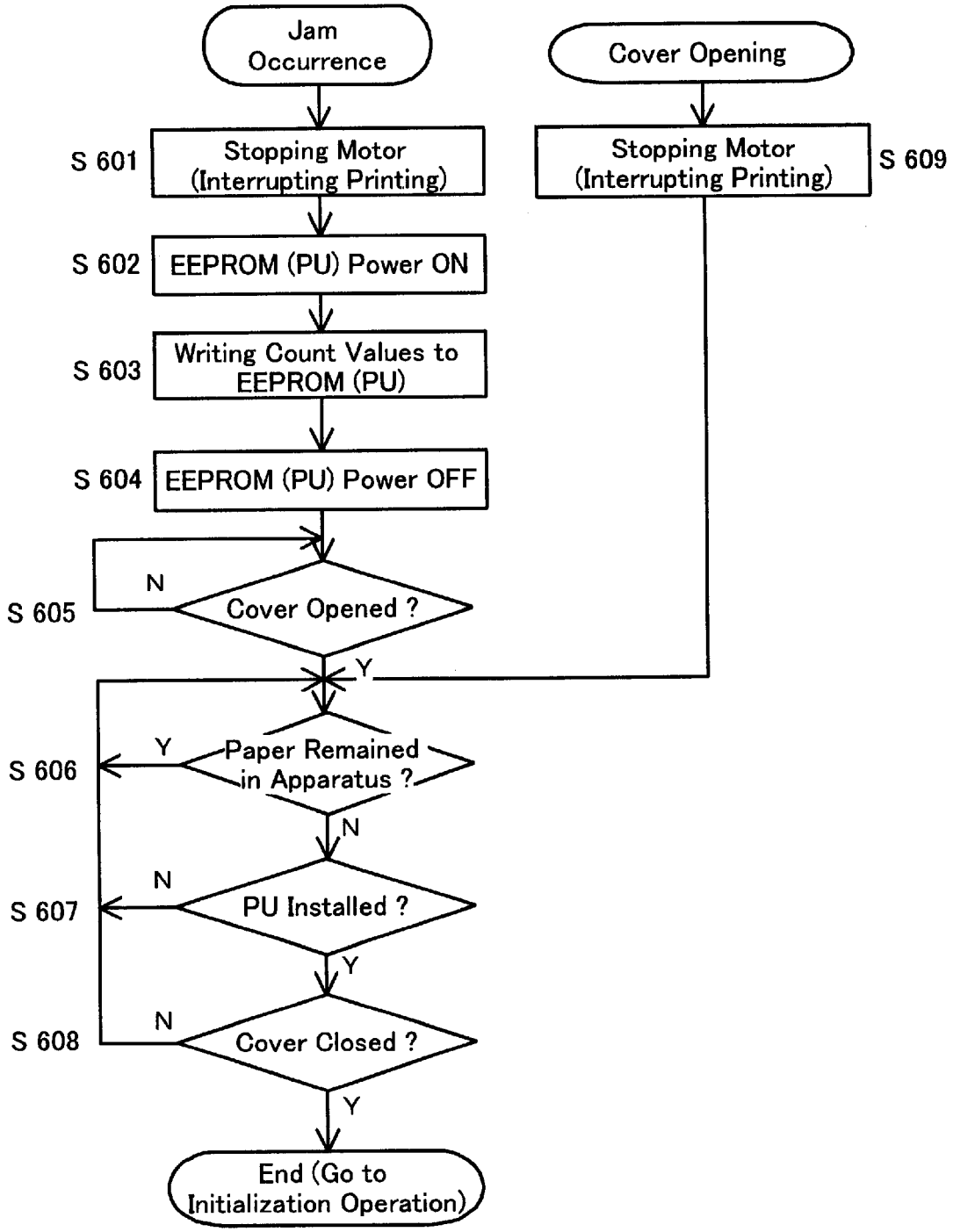
FIG. 12 is a processing flow chart of the electrophotography apparatus when there is a paper jam and when the cover is open.

FIG. 12 is a processing flow chart of the electrophotography apparatus when there is a paper jam and when the cover is open. When a jam occurs, the rotation of the motor is halted and printing is interrupted in step S601. In step S602 the power to the PU memory 40 of the printing unit 4 is turned on (power is supplied). In step S603 the count value of the main unit memory 108 of the main unit control circuit 100 (in the second embodiment, the current count value) is written to the PU memory 40. In step S604 the power to the PU memory 40 is turned off (power supply is halted). In step S605 it is determined whether the cover is open or not. The jammed paper cannot be removed from inside the apparatus unless the cover is opened. If an open cover is detected, it is then determined in step S606 whether there is paper remaining in the apparatus. When the paper is removed from the apparatus, it is determined in step S607 whether the printing unit 4 has been installed. This is because the cover is open, so there is the possibility that the printing unit 4 has been removed. If the printing unit is found to be installed, it is determined in step S608 whether the cover has been closed. If the cover has been closed, then one of the initialization operations of FIGS. 5 to 7 discussed above is executed.

If the cover is opened, regardless of whether there is a paper jam, the motor is halted and printing is interrupted in step S609. Thereafter, the processing of the above-mentioned steps S606 to S608 is executed, and will therefore not be described again.

Figure 13:
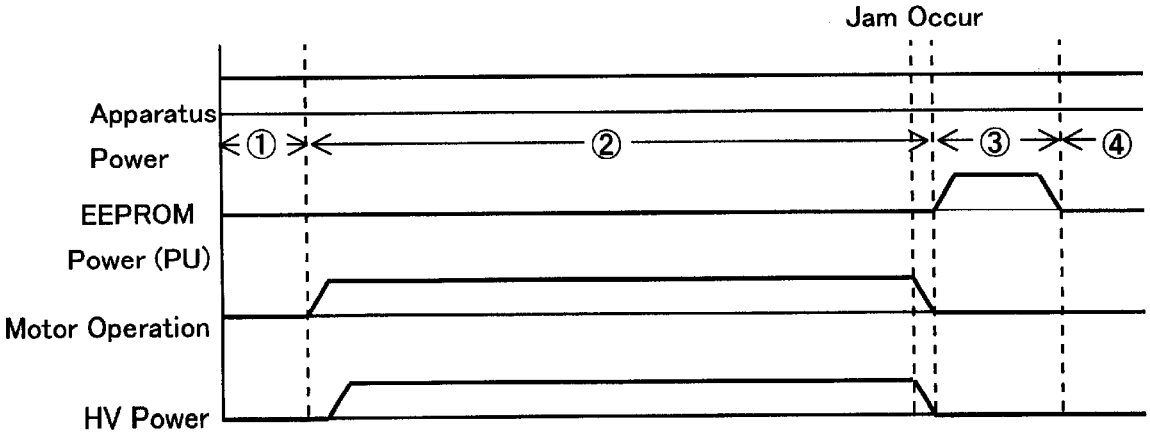
FIG. 13 is a diagram illustrating the timing of the power supply to the PU memory 40 when there is a paper jam.

FIG. 13 is a diagram illustrating the timing of the power supply to the PU memory 40 when there is a paper jam. Referring to the processing flow chart in FIG. 12, period ① is a print stand-by period. Period ② is the period of the printing state, and corresponds to the processing period of steps S403 to S408 in FIG. 9. In this period, the motor is driven and high-voltage (HV) power is supplied to the printing unit 4. If a paper jam occurs, the motor drive and the high-voltage power supply are halted in step S601. Period ③ is a period in which power is supplied to the PU memory 40, and is the processing period of steps S602 to S604. Therefore, here again, the supply of power to the PU memory 40 is halted while the motor is being driven and the high-voltage power is being supplied, which prevents malfunction of the PU memory 40. Period ④ is a period of processing for recovery from the jam corresponding to steps S605 to S608.

Figure 14:
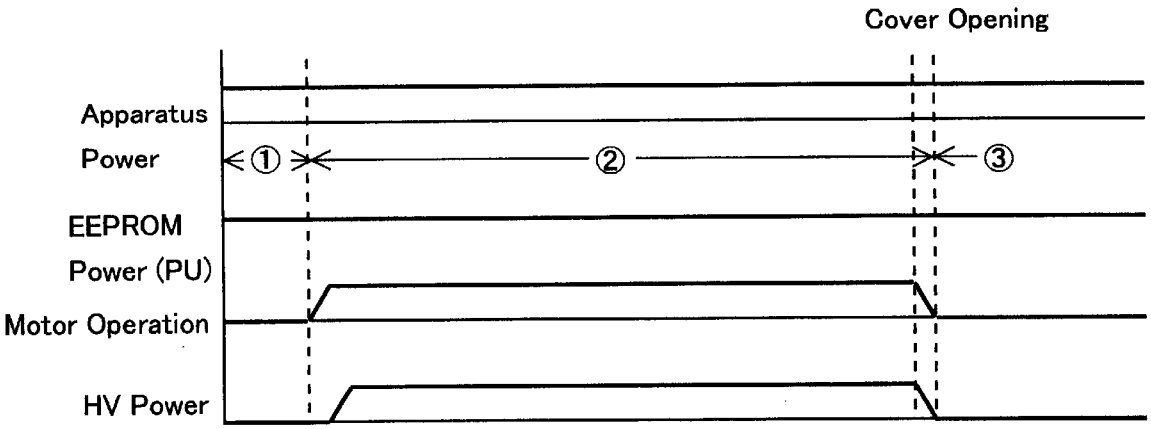
FIG. 14 is a diagram illustrating the timing of the power supply to the PU memory 40 when the cover is open.

FIG. 14 is a diagram illustrating the timing of the power supply to the PU memory 40 when the cover is open. Referring to the processing flow chart in FIG. 12, period ① is a print stand-by period. Period ② is the period of the printing state, and corresponds to the processing period of steps S403 to S408 in FIG. 9. In this period, the motor is driven and high-voltage (HV) power is supplied to the printing unit 4. If the cover is opened during printing, the motor drive and the high-voltage power supply are halted. Period ③ is a period in which power is supplied to the PU memory 40, and is the processing period of steps S409 to S411 after printing is complete. Therefore, here again, the supply of power to the PU memory 40 is halted while the motor is being driven and the high-voltage power is being supplied, which prevents malfunction of the PU memory 40. Period ③ is a period in which the cover is open, and since there is the possibility that the printing unit 4 will be removed, there are cases when writing to the PU memory 40 is impossible, so no power is supplied to the PU memory 40 during this period.

In the embodiments of the present invention, the count value of the main unit memory 108 of the main unit control circuit 100 (the current count value) was incremented by one every time a sheet was printed, but the count value may instead be incremented by a certain number of sheets every time that number of sheets is printed.

Also, in the embodiments of the present invention, the count values of the two EEPROMs were compared on the assumption that the printing unit was replaced when the cover was opened and closed, but if the electrophotography apparatus is equipped with a sensor for directly detecting that the printing unit has been removed, then the count values need not be compared when this removal has been detected.

Also, in the embodiments of the present invention, the count values written to the main unit memory 108 and the PU memory 40 were based on the number of printed sheets, but count values corresponding to the printing time may be written instead. In this case, the count value written to the main unit memory (EEPROM) 108 is updated every specific unit of printing time.

The protected scope of the present invention is not limited to the embodiments given above, and extends to inventions described in the Claims and equivalents thereof.

With the present invention, a non-volatile memory for storing a count value for managing the service life of a printing unit is installed in both the main unit and the printing unit of the electrophotography apparatus. Then, the count value is written to the memory on the printing unit (PU) side (PU memory) when print processing is not in progress, and no power is supplied to the PU memory during print processing, so the correct count value is always stored in the PU memory. Therefore, the service life of the printing unit can be correctly evaluated.

Also, whether or not the printing unit has been replaced can be determined by comparing the count value of the memory on the main unit side (main unit memory) to the count value of the PU memory. Therefore, even if the user fails to use the control panel to input that the replacement of the printing unit is complete, the processing required when a printing unit is replaced can be performed automatically.

What is claimed is:

1. An electrophotography apparatus including a main unit and a printing unit which is replaceably built into the main unit, said electrophotography apparatus comprising:

a first non-volatile memory mounted in the main unit;

a second non-volatile memory mounted in the printing unit; and a controller for writing a count value, which is updated every specific unit of printing time or every specific number of printed sheets, as a first count value to the first non-volatile memory after every update during print processing, writing the first count value as a second count value to the second non-volatile memory upon completion of the print processing, and evaluating the service life of the printing unit on the basis of the first count value or the second count value.

2. The electrophotography apparatus according to claim 1, wherein the controller does not supply power to the second non-volatile memory during print processing, but does supply power to the second non-volatile memory at least during writing to the second non-volatile memory upon completion of the print processing.

3. The electrophotography apparatus according to claim 1, wherein the controller determines whether the printing unit has been replaced on the basis of a comparison of the first count value and the second count value after the occurrence of an incident in which there is the possibility that the printing unit has been exchanged.

4. The electrophotography apparatus according to claim 3, wherein said incident is when the cover for replacing the printing unit has been opened and closed and/or when the printing unit has been removed and reinstalled.

5. The electrophotography apparatus according to claim 3, wherein the controller determines that the printing unit has been replaced when the difference between the first count value and the second count value is over a specific value.

6. The electrophotography apparatus according to claim 3, wherein the controller determines that the printing unit has been replaced when the first count value is less than the second count value and when the first count value is greater by a specific value than the second count value.

7. The electrophotography apparatus according to claim 5, wherein said specific value is the maximum possible number of continuously printed sheets, or the printing time corresponding to this number, or a value less than these.

8. The electrophotography apparatus according to claim 7, wherein said specific value is the greater of the number of continuously printed sheets and the printing time in the past N (N is a natural number) times of printing.

9. The electrophotography apparatus according to claim 3, wherein the controller writes the first count value as the second count value to the second non-volatile memory when the first count value differs from the second count value and it has been determined that the printing unit has not been replaced.

10. The electrophotography apparatus according to claim 3, wherein the controller writes the first count value as a third count value to the first non-volatile memory upon completion of the print processing and determines whether the printing unit has been replaced on the basis of a comparison of the third count value and the second count value.

11. The electrophotography apparatus according to claim 10, wherein the controller determines that the printing unit has been replaced when there is a difference between the third count value and the second count value.

12. The electrophotography apparatus according to claim 3, wherein the controller writes the second count value of the printing unit as the first count value of the first non-volatile memory when it has determined that the printing unit has been replaced.

13. The electrophotography apparatus according to claim 12, wherein the controller executes the required processing when the printing unit has been replaced.

14. The electrophotography apparatus according to claim 13, wherein said processing is printing density correction and/or a time extension of the initial setting.

* * * * *